United States Patent [19]

Hosono et al.

[11] 4,395,110

[45] Jul. 26, 1983

[54] DEVELOPING DEVICE WITH APPLICATOR CONTOURED TO STIR DEVELOPER APPLIED TO A DEVELOPER SUPPORT

[75] Inventors: Nagao Hosono, Chofu; Hatsuo Tajima, Matsudo, both of Japan

[73] Assignee: Canon Kabushiki Kaisha, Tokyo, Japan

[21] Appl. No.: 238,633

[22] Filed: Feb. 26, 1981

[30] Foreign Application Priority Data

Mar. 4, 1980 [JP] Japan ..... 55-27730
Mar. 4, 1980 [JP] Japan ..... 55-27731

[51] Int. Cl.[3] ..... G03G 15/08
[52] U.S. Cl. ..... 355/3 DD; 118/657; 118/261
[58] Field of Search ..... 355/3 DD, 3 R; 118/657, 118/658, 261

[56] References Cited

U.S. PATENT DOCUMENTS 2,466,734 4/1949 Piazze ..... 118/261 X
4,040,387 8/1977 Washio et al. ..... 118/658
4,233,935 11/1980 Uehara et al. ..... 355/3 DD
4,261,290 4/1981 Yamashita et al. ..... 355/3 DD
4,286,543 9/1981 Ohnuma et al. ..... 118/658 X

*Primary Examiner*—R. L. Moses
*Attorney, Agent, or Firm*—Fitzpatrick, Cella, Harper & Scinto

[57] ABSTRACT

A developing device has developer support positioned with a small clearance between it and a latent image bearing member, a developer supply device for supplying developer onto the surface of developer support, and an applying device for applying the developer in a layer of a defined thickness on the developer support. The applying device is positioned in the proximity of or in contact with the developer support and is provided with protrusions or recesses at least in an area facing the developer support. Therefore, a uniform developer layer is formed on the developer support.

12 Claims, 9 Drawing Figures

DEVELOPING DEVICE WITH APPLICATOR CONTOURED TO STIR DEVELOPER APPLIED TO A DEVELOPER SUPPORT

BACKGROUND OF THE INVENTION

1. Field of the Invention

The present invention relates to a developing device utilizing electrophotographic developer, and more particularly to a developing device in which a thin uniform layer of a one-component developer, particularly an insulating non-magnetic one-component developer is formed on developer support means and is brought into facing relationship to a latent image bearing member for developing the latent image formed thereon.

2. Description of the Prior Art

There are already known or proposed various developing devices utilizing one-component developer. Among these is the so-called toner transition development device in which one-component developer is applied on the developer support means as a thin uniform layer which is then brought into facing relationship to an electrostatic latent image bearing surface with a small clearance therebetween. The developer is then caused to fly from the developer support means to the image bearing surface by the electrostatic attractive force to achieve image development, as disclosed in the Japanese Patent Publication Sho41-9475 and the U.S. Pat. No. 2,839,400. Such development provides a satisfactory image completely free from background fog, as the non-image area does not attract the developer and moreover is not even brought into contact with the developer. Also the absence of carrier particles in the one-component developer avoids the troubles resulting from the variation in the mixing ratio of developer or from the deterioration of the carrier particles.

Apart from the aforementioned development method and device, the present applicant proposed novel developing methods as disclosed in the U.S. patent application Ser. Nos. 938,101 and 938,494 and in Ser. Nos. 58,434 and 58,435, now U.S. Pat. No. 4,292,387, issued Sept. 9, 1981.

The former method utilizes one-component magnetic developer, non-magnetic developer support means and magnetic-field generating means arranged in this order to form a thin uniform layer of the developer support means by the magnetic force caused by said magnetic-field generating means. The developer layer is brought into facing relation to an electrostatic latent image bearing surface with a small clearance therebetween, whereby the developer present corresponding to an image area is extended by the electrostatic attractive force of said latent image to achieve image development. This method also provides an image completely free from background fog as the development is effected without the contact of developer with the non-image area.

The latter method utilizes one-component magnetic developer, non-magnetic developer support means and magnetic-field generating means arranged in this order to form a thin uniform layer of the developer on the developer support means by the magnetic force caused by said magnetic-field generating means. The developer layer is brought into facing relation to an electrostatic latent image bearing surface with a small clearance therebetween, wherein the image development is carried out by applying an AC developing bias field across said small clearance and creating a time-dependent change in the clearance between said latent image bearing surface and the developer support means. In such method the developer also reaches the non-image area of the electrostatic latent image in the earlier state of the development to achieve image development in the halftone image area, but remains in contact only with the image area in the latter state. This method thus provides a development without background fog and with improved halftone reproduction in comparison with the above-mentioned developing method.

As explained in the foregoing, the developing methods utilizing a thin layer of developer maintained in facing relation to the latent image bearing surface are far superior, with respect to the developing performance, image reproducibility and service life of developer, to other conventionally known developing methods.

Preferred in such new developing methods is the use of toner of high electric resistance or insulating toner, in consideration of the ease of transfer onto plain paper.

One-component magnetic developer, due however to the magnetic particles contained in the developer particles, is more expensive than the non-magnetic developer and is difficult to produce in satisfactorily pure colors. Besides the developing device for magnetic developer is not only heavy but also expensive due to the use of magnets behind the developer support means. For these reasons the developing method and device utilizing one-component non-magnetic developer is desirable.

In fact the latent image development with one-component non-magnetic developer has long been known in the filed of electrophotography, but such conventionally known method has been not entirely satisfactory in being characterized by poor service life of the developer, leading to the gradual decrease in developed density and in the difficulty of uniform and stable developer application on the developer support means. Also such method has been associated with a phenomenon of a difference in the thickness of developer layer on the developer support means between an area in which the developer is taken away by the preceding development and an area not subjected to such preceding removal of developer, said difference being reproduced as a difference in density in the image thus obtained.

There is also proposed a method of applying developer onto the developer support means having surface irregularities, but the above-mentioned phenomenon is still associated with such method. In order to prevent such phenomenon there is proposed a method of removing the remaining developer from the developer support means after the development and uniformly applying the developer anew on said support means. Such removal of developer is also effective in preventing the surface of said support means from being covered by minute particles of the developer or other substances, which otherwise undesirably affects the frictional charging between the developer and said support means. In such method, however, the support means with surface irregularities is not suitable as such irregularities will hinder the removal of developer. On the other hand the support means with a smooth surface will inevitably limit the thickness of developer layer uniformly applicable thereon, thus leading to a low image density. The abovementioned method has thus not been entirely satisfactory for uniform and stable developer application, for stable and uniform developer charging and for stability in obtainable image density.

SUMMARY OF THE INVENTION

The object of the present invention is to provide a developing device not characterized by the aforementioned drawbacks.

Another object of the present invention is to provide a developing device capable of preventing uneven thickness in the developer layer on the developer support means and allowing uniform application of the developer.

Still another object of the present invention is to provide a developing device capable of breaking aggregates of developer on the developer support means and allowing the formation of a new developer layer after the previous developer layer is scraped off from the support means.

Still another object of the present invention is to provide a developing device capable of causing turbulence in the developer on the support means thereby providing the developer with an electrostatic charge.

The foregoing objects can be achieved according to the present invention with a developing device comprising developer support means positioned in facing relationship to a latent image bearing member with a small clearance therebetween, developer supply means for supplying the developer to the surface of said developer support means and applying means for applying said developer in a layer of a defined (limited) thickness on said developer support means, wherein said applying means is positioned in the proximity of or in contact with said developer support means and is provided with protrusions or recesses at least in an area facing said developer support means. These objects can also be achieved according to the present invention with a developing device comprising developer support means positioned in facing relationship to a latent image bearing member with a small clearance therebetween, developer supply means for supplying the developer to the surface of said developer support means and applying means for applying said developer into a layer of a defined thickness on said developer support means, wherein said applying means is composed of a screen positioned in the proximity of or in contact with said developer support means, said screen being adapted to pass the developer from the rear side thereof for supply onto said developer support means.

The foregoing and still other objects and advantages of the present invention will be made apparent from the following description to be taken in conjunction with the attached drawings.

DESCRIPTION OF THE PREFERRED EMBODIMENTS

Now the present invention will be explained in detail with reference to the embodiments thereof shown in the attached drawings.

Figure 1:
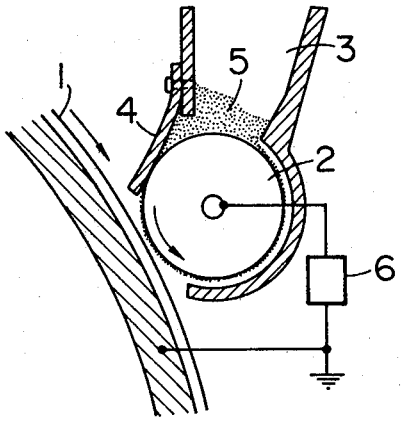
FIG. 1 is a cross-sectional view of a developing device embodying the present invention.

FIG. 1 schematically shows an embodiment of a developing method and a device for developing an electrostatic latent image utilizing a one-component non-magnetic developer, wherein an electrostatic latent image is formed on a cylindrical latent image bearing member 1 through an electrophotographic process such as the well-known Carlson process or the NP process disclosed in the U.S. Pat. No. 3,666,363. The image is rendered visible by image development with an insulating non-magnetic developer 5 which is supplied from a hopper 3 constituting developer supply means and is coated as a layer of a defined thickness on developer support means 2 by applying means 4. The developer support means 2 is composed of a cylindrical developing roller made of stainless steel, which may however be composed of aluminum or other suitable metals or may be coated with a resin for causing frictional charging of the developer into a desired polarity. Furthermore said developing roller may be composed of an electrically conductive non-metallic material. Said developer support means 2 is provided, on both ends thereof, with unrepresented spacer rollers made of high-density polyethylene, and the developing device is positioned so that said spacer rollers remain in contact with the both ends of the latent bearing member 1, whereby the clearance between said member 1 and the developer support means 2 is defined larger than the thickness of developer applied on said developer support means 2. The clearance is selected normally within a range of 100 to 500$\mu$, preferably 150 to 300$\mu$. An excessively large clearance will lower the electrostatic force applied from the electrostatic latent image to the developer coated on the developer support means 2, thus lowering the image quality particularly in the reproduction of fine lines, while an excessively small clearance may result in the compression of developer between the developer support means 2 and the latent image bearing member 1, eventually causing aggregation of the developer. This is related to the minimum developer thickness of ca. 50$\mu$, preferably ca. 80$\mu$ on the developer support means 2 for obtaining the required image density. The transport speed of the developer with the developer support means 2 into the developing area where it is in the proximity of the latent image bearing member may be selected larger than the peripheral speed of the latent image bearing member 1, but such higher speed will cause scattering of the developer from the developer support means 2, particularly in case of non-magnetic developer. Also substantially same speeds are preferred in consideration of the image quality. A developing bias voltage source 6 is provided to apply a voltage across the electroconductive developer support means 2 and a backing electrode of the latent image bearing member 1, said voltage constituting a developing bias as described in the aforementioned U.S. patent application Ser. No. 58,435. Employed in the described example was one-component developer (not containing carrier particles larger than the toner particles) composed solely of toner with an average particle size of 7μ for the Canon copier NP5000, or of a mixture of said toner with hydrophobic silica of an average particle size of 16μ (Aerosil R972 supplied by Nippon Aerosil Co.) in a ratio of 0.4 to 1% by weight. Also employed was a Canon copier NP200 in which a developing device of the present invention was fitted. The developing bias was given by a sinusoidal voltage of a peak-to-peak value Vpp of 1500 V and a frequency of 800 Hz overlapped with a DC voltage of +150 V to obtain a clear image with satisfactory quality.

Figure 2A:
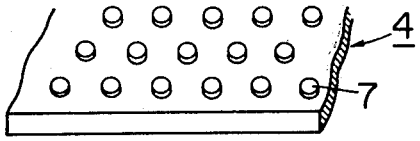
FIGS. 2A and 2B are partial perspective views showing different embodiments of the developer applying means for use in the developing device of the present invention.
Figure 2B:
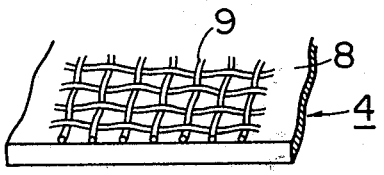

FIGS. 2A and 2B show examples of the applying means 4 to be employed in the developing device in FIG. 1, for applying the developer on the developer support means 2 and defining the thickness of developer layer thus obtained. Said applying means is provided with irregularities or projections at least on a surface thereof facing the developer support means 2. Said projections or irregularities 7, 9 may be composed of the same material as or formed integrally with said applying means 4, or of a different member or a different material such as, for example short fibers planted on a elastic member. In such case the fibers should be of a small thickness for example not exceeding 100μ, preferably 50μ. Also in case said irregularities or projections comprise a separate member, it need not necessarily be adhered to an underlying member but may be simply superposed thereon. FIG. 2A shows an example of the applying means 4 having cylindrical projections formed integrally therewith. Said projections may also be of a semi-spherical shape.

FIG. 2B shows an example of the applying means 4 composed of a silicone rubber plate 8 of a thickness of 2 mm and a hardness of 60° functioning as an elastic press member overlaying a flexible nylon screen 9, for example with apertures of 161μ composed of plain woven nylon filaments of 71μ. The screen may also be of twill weave, satin weave or the like, and may be of a metal or a macromolecular material such as polyester or nylon. The material constituting the screen, however, affects the charge to be given to the developer at the application thereof onto the support means 2, even if the screen structure remains the same. As an example a nylon screen of the above-mentioned structure provided a surface potential of −70 V on the developer layer applied on a developer support means made of stainless steel, but a polyester screen provided a surface potential of −40 V under the same conditions. Naturally the charging of developer at the application thereof is caused also between the developer and the support means 2.

The irregularities on the surface of the applying means 4 facing the developer support means 2 not only functions to maintain a predetermined clearance between said support means 2 and said applying means 4 for allowing the passage of developer but also to agitate the developer present on the developer support means 2 thereby breaking the aggregates therein or to eventually scrape off the once applied developer layer and to cause thus scraped developer to pass in said clearance by means of the mutual movement of the applying means 4 and the developer support means 2 thereby forming a developer layer anew on the support means 2. Such developer application under agitation and with aggregate breaking is naturally effective for the charging of developer. The above-mentioned facts are particularly important in the use of a one-component insulating developer.

Now, in case of the developer application by the rotation of the developer support means 2 as shown in FIG. 1, the portions of developer layer on said support means 2 which have been in contact with or in the vicinity of said protrusions of the applying means 4 at the final stage of the developer application become thinner. Therefore, it is necessary to prevent such unevenness in the applied developer layer from appearing in the developed image. For this purpose the extent of spreading of each protrusion has to be carefully designed. For example in case of the structure shown in FIG. 2B, the pattern of nylon filaments does not appear on the developed image in the development under the aforementioned developing bias when the filament diameter is 71μ, but such pattern becomes clearly visible when said diameter is equal to 500μ. Besides said pattern becomes less conspicuous when said developing bias voltage is applied across the backing electrode of the latent image bearing member 1 and the developer support means in comparison with a case of absence of such developing bias. This fact indicates that the development under a developing bias voltage reduces the effect to the resulting image of uneven coating of the developer on the developer support means 2.

Figure 3:
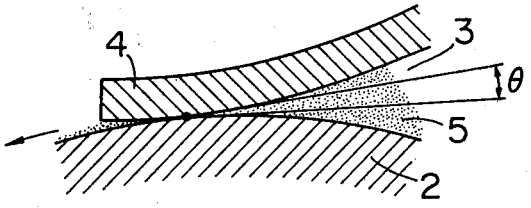
FIG. 3 is a schematic view showing an embodiment of the applying means.

FIG. 3 shows the angular relationship between the applying means 4 and the developer support means 2. Particularly in case of one-component non-magnetic developer it is not possible to transport the developer nor to attract the developer toward the support means 2 by the magnetic force. Consequently if the applying means 4 forms, at a position in contact with or closest to the developer support means, a rectangular or larger angle with respect thereto toward the developer supply means 3, the developer tends to merely slip on the support means 2 when it is rotated as illustrated and scarcely enters the clearance between the applying means 4 and the support means 2. On the other hand, in case said applying means 4 forms, at a position in contact with or closest to the developer support means, an acute angle $\theta$ with respect thereto toward the developer supply means 3 as shown in FIG. 3, the developer enters the clearance between applying means 4 and the support means 2 upon rotation thereof and is easily applied thereon.

In addition to the foregoing, an improved developer coating on the support means 2 can be assured by the means to be explained as follows with respect to FIGS. 4 and 5.

Figure 4A:
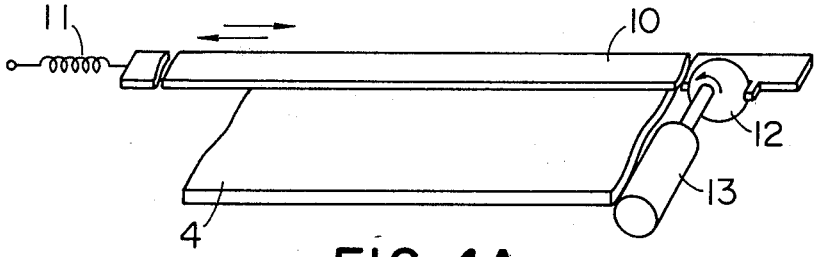
FIG. 4A is a perspective view of an embodiment of the developer applying means.
Figure 4B:
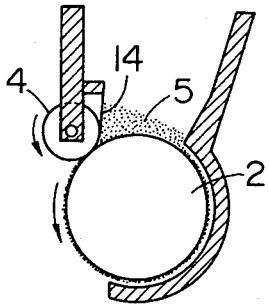
FIG. 4B is a cross-sectional view of a variation thereof.

In the embodiments shown in FIGS. 4A and 4B, the applying means 4 is rendered movable to enhance the agitation of the developer 5 on the support means 2, thereby reducing the unevenness in the application and thus improving the developer layer obtained. In FIG. 4A a mounting member 10 supporting the applying means 4 is constantly biased at an end thereof by a spring 11, and a cam 12 rotated by a motor 13 causes a reciprocating motion of said mounting member 10 in the longitudinal direction thereof, whereby the applying means 4 performs the developer application under reciprocating motion in the longitudinal direction of the developer support means 2.

Also FIG. 4B shows another embodiment of the applying means 4 formed as a roller for performing the application, under rotation, of the developer 5 onto the support means 2. A scraper 14 made of a polyester film of 200μ thickness is provided for scraping off the excessive developer from said roller.

Figure 5:
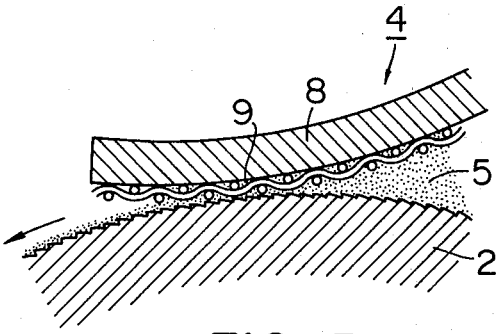
FIG. 5 is a schematic view of another embodiment of the developer applying means.

FIG. 5 shows another embodiment in which the developer support means 2 is provided with a coarse surface for facilitating the engagement of developer with said surface by the movement thereof in the direction of the arrow, thereby increasing the thickness of the developer layer and thus elevating the image density. The above-mentioned effect is sufficiently achievable even if the surface coarseness of the support means 2 is smaller than the particle size of the developer, for example with a coarseness of 1 to 2μ in combination with the developer of an average particles size of 7μ. Such surface coarseness can be easily obtained by rubbing the surface of cylindrical developer support means 2 made of stainless steel with a #600 sandpaper. In FIG. 5 there are also shown a pressing member 8 composed of an elastic silicone rubber plate of a thickness of 2 mm and of a hardness of 60° and a flexible screen 9 such as shown in FIG. 2B, but these members may be replaced by other applying means of the present invention. It is furthermore possible to expect developer movement caused by mutually parallel linear surface patterns provided on the developer support means 2 diagonally to the axis thereof and anoset of mutually parallel linear surface patterns provided on the applying means 4, said two sets of patterns being so arranged as to mutually intersect, thereby forming a checkerboard or rhombic pattern. A wide variety of patterns is usable for realizing such developer movement.

Figure 6:
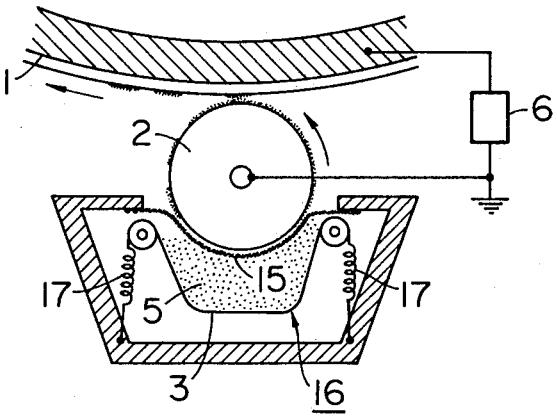
FIG. 6 is a cross-sectional view of an embodiment of the developing device of the present invention utilizing screen-shaped applying means.

FIG. 6 shows, in a cross-sectional view, another embodiment of the present invention utilizing screen-structured applying means, wherein provided is means 16 for pressing the developer 5 present behind said screen 15 toward the developer support means 2 in order to forcedly supply the developer into the clearance between said support means 2 and the screen 15 through the apertures thereof. The presence of such means 16 is effective particularly in case of one-component non-magnetic developer as it is not possible to transport the developer nor to attract the developer toward the support means 2 by magnetic force. The thickness of the developer layer on the support means 2 increases when the pressing force for the means 16 toward said support means 2 in increased. Also said pressing means 16 may be used not only in a developing device wherein the hopper 3 constituting the developer supply means 3 is positioned under the support means 2 as shown in FIG. 6 but also in a developing device wherein said hopper 3 is positioned above the support means 2 as shown in FIG. 1. In the embodiment shown in FIG. 6, said pressing means 16 is composed of a hopper 3 made of a polyester film which is fixed at both ends thereof under tension through springs 17, 17. Said pressing means 16 may also be composed of an elastic member such as a rubber sheet, and the resulting pressing force may be applied onto a part of the area where said screen 15 is in contact with or in the proximity of said support means 2.

Said screen 15 constituting the applying means may be rendered movable for increasing the agitation of the developer present on the support means 2, thereby reducing the unevenness in the application and thus providing an improved developer layer.

As already shown in FIG. 5, the developer support means 2 may be provided with a coarse surface for facilitating the engagement of developer with said surface by the movement thereof in the direction of the arrow, thereby increasing the thickness of developer layer and thus increasing the image density. The above-mentioned effect is sufficiently achievable even if the surface coarseness of the support means 2 is smaller than the particle size of the developer, for example with a coarseness of 1 to 2μ in combination with the developer of an average particle size of 7μ. Such surface coarseness can be easily obtained by rubbing the surface of cylindrical developer support means 2 made of stainless steel with a #600 sandpaper.

In FIG. 6, for the purpose of simplicity, the components corresponding to those in FIG. 1 are represented by same numbers.

Figure 7:
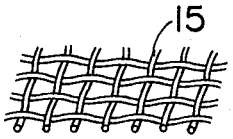
FIG. 7 is a partial perspective view of screen-shaped applying means.

The screen 15 constituting the applying means has a structure, as shown in FIG. 7, made of plain woven nylon filaments of a diameter of 71μ, with apertures of 161μ. Said screen 15 is positioned in the proximity of the developer supply means 3 and in the proximity of or in contact with the developer support means 2, and functions to transmit an adequate amount of developer toward the support means 2 through said apertures, to agitate the developer in the clearance between said screen 15 and the support means 2 for breaking the aggregates, and to apply said developer onto said support means 2 with frictional charging in a desired polarity between said developer and the support means 2 or the screen 15. The above-mentioned effects are particularly important in the use of one-component developer. The developer 5 is not only supplied toward the support means 2 through the apertures of said screen 15 but also is partly returned toward the hopper 3 through said apertures. Said screen moreover functions to scrape off the developer remaining on the support means 2 after the image development and to apply the developer anew on said support means 2.

The screen may also be of twill weave, satin weave or the like, and may be of a metal or a macromolecular material such as polyester or nylon. The material constituting the screen, however, affects the charge to be given to the developer at the application thereof onto the support means 2, even if the screen structure remains same. As an example a nylon screen of the above-mentioned structure provided a surface potential of −70 V on the developer layer applied on a developer support means made of stainless steel, but a polyester screen provided a surface potential of −40 V under the same conditions. Naturally the charging of developer at the application thereof is caused also between the developer and the support means 2.

Now, in case of the developer application by the rotation of the developer support means 2 as shown in FIG. 6, the portions of the developer layer on said support means 2 which have been in contact with or in the vicinity of the protrusions of the applying means 4 at the final stage of the developer application become thinner, so that it is necessary to prevent such unevenness in the applied developer layer from appearing in the developed image. For this purpose the extent of spreading of each protrusion has to be carefully designed. For example in case of the structure shown in FIG. 7, the pattern of nylon filaments does not appear on the developed image in the development under the aforementioned developing bias when the filament diameter is 70 or 100μ, but such pattern becomes clearly visible when said diameter is equal to 500μ. Besides said pattern becomes less conspicuous when the aforementioned developing bias voltage is applied across the backing electrode of the latent image bearing member 1 and the developer support means 2, in comparison with a case of absence of such developing bias. This fact indicates that the development under a developing bias voltage reduces the effect to the resulting image of uneven coating of the developer on the support means 2.

As explained in detail above, the drawbacks inherent in the conventional developing devices are substantially resolved by the developing method and device of the present invention which provides for positioning developer support means in facing relation to a latent image bearing member with a small clearance therebetween and suppling the developer onto said support means by means of applying means having surface irregularities or protrusions, or positioning developer support means in facing relation to a latent image bearing member with a small clearance therebetween and supplying the developer onto said support means through screen-structured applying means. Furthermore the present invention forms a uniform thin layer of one-component developer, particularly insulating one-component non-magnetic developer, on the developer support means, thereby enabling stable and satisfactory image quality to be obtained utilizing one-component non-magnetic developer. However, the present invention is naturally applicable also to the developing method utilizing magnetic toner.

What we claim is:

1. A developing device for developing a latent image formed on a latent image bearing member with a developer, comprising:

developer support means positioned with a small clearance between it and said latent image bearing member;

developer supply means for supplying the developer to said developer support means; and applying means for applying the developer supplied by said developer supply means onto the surface of said developer support means and for defining the thickness of a layer of the developer on said developer support means;

said applying means being positioned in the proximity of or in contact with said developer support means, and comprising a screen provided with surface irregularities at least on a surface thereof facing said developer support means and a pressing member for pressing said screen against said developer support means.

2. A developing device for developing a latent image formed on a latent image bearing member with a dry developer, comprising:

developer support means positioned with a small clearance between it and said latent image bearing member;

developer supply means for supplying the dry developer to said developer support means; and applying means for applying the dry developer supplied by said developer supply means onto the surface of said developer support means and for defining the thickness of a layer of the dry developer on said developer support means, said applying means being positioned in the proximity of or in contact with said developer support means and being provided with surface irregularities at least on a surface thereof facing said developer support means for stirring the dry developer and preventing coagulation thereof on said developer support means, said applying means including a screen and a pressing member for pressing said screen against said developer support means.

3. A developing device according to claim 2 or 1, wherein said pressing member comprises an elastic member.

4. A developing device according to the claim 2 or 1, wherein said applying means is so positioned as to form, at a position thereof closest to or in contact with said developer support means, an acute angle to said developer support means toward said developer supply means.

5. A developing device for developing a latent image formed on a latent image bearing member with a developer, comprising:

developer support means positioned with a small clearance between it and said latent image bearing member;

developer supply means for supplying a developer to said developer support means; and applying means for applying the developer supplied by said developer supply means onto the surface of said developer support means and for defining the thickness of a layer of the developer on said developer support means, said applying means comprising a screen which is positioned in the proximity of or in contact with said developer support means, said applying means being adapted to supply the developer through said screen for application onto said developer support means.

6. A developing device according to claim 5, further comprising means for pressing the developer through said screen toward said developer support means.

7. A developing device according to claim 2, 5 or 1 wherein said applying means is adapted to charge said developer in a polarity opposite to that of said latent image.

8. A developing device according to claim 2, 5, or 1, wherein said applying means is displaceable relative to said developer support means to apply said developer onto said developer support means.

9. A developing device according to claim 2, 5 or 1 wherein said developer support means is provided with a coarse surface for facilitating application of the developer thereon.

10. A developing device according to claim 9, wherein said coarseness exceeds $1\mu$.

11. A developing device according to claim 2, 5, or 1, wherein the clearance between said developer support means and said latent image bearing member is larger than the thickness of the layer of developer applied to said developer support means, and further comprising means for applying an AC electric field between said developer support means and said latent image bearing member.

12. A developing device for developing a latent image formed on a latent image bearing member with a one-component developer, comprising;

a developing roller positioned under and with a small clearance between it and said latent image bearing member, said clearance being larger than the thickness of a layer of one-component developer applied on said developing roller;

means for applying an AC electric field across the clearance between said developing roller and said latent image bearing member;

a hopper for supplying one-component developer to the surface of said developing roller;

screen-structured applying means, comprising a screen, for applying the developer onto said developing roller and for defining the thickness of the developer layer on said developing roller said screen-structured applying means being positioned in the proximity of or in contact with said developing roller and being adapted to supply said developer through said screen for application onto said developing roller; and urging means for pressing said developer contained in said hopper toward said developing roller through said screen.

* * * * *